US009950832B2

(12) United States Patent
Gogola et al.

(10) Patent No.: US 9,950,832 B2
(45) Date of Patent: Apr. 24, 2018

(54) BEVERAGE CAN END FRANGIBLE SCORE GEOMETRY

(71) Applicant: Rexam Beverage Can Company, Chicago, IL (US)

(72) Inventors: Michael R. Gogola, Itasca, IL (US); Randall G. Forrest, Park Ridge, IL (US); Rex Villasin, Schaumburg, IL (US); Jonathan P. Meyer, Chicago, IL (US)

(73) Assignee: REXAM BEVERAGE CAN COMPANY, Chicago, IL (US)

( * ) Notice: Subject to any disclaimer, the term of this patent is extended or adjusted under 35 U.S.C. 154(b) by 132 days.

(21) Appl. No.: 14/814,993

(22) Filed: Jul. 31, 2015

(65) Prior Publication Data

US 2017/0029165 A1 Feb. 2, 2017

(51) Int. Cl.
*B65D 17/00* (2006.01)

(52) U.S. Cl.
CPC ..... *B65D 17/165* (2013.01); *B65D 17/161* (2013.01); *B65D 17/24* (2013.01); *B65D 2517/0013* (2013.01); *B65D 2517/0014* (2013.01); *B65D 2517/0026* (2013.01); *B65D 2517/0062* (2013.01); *B65D 2517/0082* (2013.01); *B65D 2517/5097* (2013.01)

(58) Field of Classification Search
CPC .... B65D 17/165; B65D 17/161; B65D 17/24; B65D 17/163; B65D 2517/0013; B65D 2517/0014; B65D 2517/0026; B65D 2517/0062; B65D 2517/0082; B65D 2517/5097
USPC ..... 220/269, 270
See application file for complete search history.

(56) References Cited

U.S. PATENT DOCUMENTS

| | | | |
|---|---|---|---|
| 3,259,265 | A | 7/1966 | Stuart |
| D338,156 | S | 8/1993 | Cook |
| 5,405,039 | A | 4/1995 | Komura |
| D364,807 | S | 12/1995 | Taylor |
| D365,274 | S | 12/1995 | Cook |
| 5,683,006 | A | 11/1997 | Cook, III |
| 7,748,557 | B2 | 7/2010 | Robinson |

(Continued)

FOREIGN PATENT DOCUMENTS

EP 0372419 B1 6/1990

OTHER PUBLICATIONS

Written Opinion and Search Report for PCT/US2016/044993 dated Oct. 20, 2016, 10 pages.

*Primary Examiner* — Andrew Perreault
(74) *Attorney, Agent, or Firm* — Greer, Burns & Crain, Ltd.

(57) ABSTRACT

An ecology stay-on tab beverage can end has a first axis extending though a rivet. A tear panel is defined by a frangible score and a non-frangible hinge that joins a first end of the frangible score with a second end of the frangible score. The first axis forms a line of asymmetry of the tear panel. A second axis intersects the first axis at a right angle. An intersection of the first axis with the second axis defines a center point of a clock-like reference having a 12 o'clock position at the first point and a 6 o'clock position at the second point. A first radius of curvature of the frangible score between a 5 o'clock position and a 7 o'clock position is at least 3.6 times larger than a second radius of curvature between a 7 o'clock position and a 9 o'clock position.

34 Claims, 6 Drawing Sheets

(56) References Cited

U.S. PATENT DOCUMENTS

| | | | | |
|---|---|---|---|---|
| 8,727,164 | B1 | 5/2014 | Majcen et al. | |
| 2003/0080132 | A1 | 5/2003 | Forrest et al. | |
| 2003/0111469 | A1 | 6/2003 | Hartman et al. | |
| 2008/0110888 | A1 | 5/2008 | Turner et al. | |
| 2011/0297679 | A1 | 12/2011 | Gogola et al. | |
| 2013/0292382 | A1 | 11/2013 | Bork | |
| 2015/0329238 | A1* | 11/2015 | Chasteen | B65D 17/165 53/492 |

* cited by examiner

BEVERAGE CAN END FRANGIBLE SCORE GEOMETRY

CROSS-REFERENCE TO RELATED APPLICATIONS

N/A

FEDERALLY SPONSORED RESEARCH OR DEVELOPMENT

N/A

TECHNICAL FIELD

The invention relates to beverage can ends having a stay-on tab ecology opening assembly; more particularly, the present invention is related to a metallic beverage can end having a frangible score geometry to promote access to the contents of a beverage container.

BACKGROUND OF THE INVENTION

Typical end closures for beer and beverage containers have an opening panel and an attached tab for pushing the opening panel into the container to open the end. The container is typically a drawn and ironed metal can, usually constructed from a thin plate of aluminum. End closures for such containers are also typically constructed from a cutedge of thin plate of aluminum or steel, formed into a blank end, and manufactured into a finished end by a process often referred to as end conversion.

These types of container ends have been used for many years, with almost all such ends in use today being the "ecology" or "stay-on-tab" ("SOT") ends in which the tab remains attached to the end, including large-opening ends ("LOE"), after a tear panel is opened. The tear panel being a portion of the can end defined by a frangible score length and a non-frangible hinge segment. The tear panel may be opened, that is the score may be severed, and the tear panel displaced at an angular orientation relative to the remaining portion of the can end, thus creating a pour opening through which the beverage may be poured from the container. The tear panel remains connected by the non-frangible hinge segment to the remaining portion of the can end by the non-frangible hinge segment, leaving an opening through which the user draws the contents of the container. In an LOE, the pour opening is about 0.5 square inches (3.23 $cm^2$) in area.

Opening of the tear panel is operated by the tab which is attached to the can end by a rivet through a rivet island on the tab. The tab is typically attached to the can end such that a nose of the tab extends over a proximal portion of the tear panel in a stowage position. A lift end of the tab is located opposite the tab nose and provides access for a user to lift the lift end, such as with the user's finger, to force the nose against the proximal portion of the tear panel. With most can ends, the stowage position and opening position are in the same location; however, some can ends known in the art require rotation of the tab from a stowage position to the opening position prior to an opening sequence, i.e. the fracturing of the frangible score.

When the tab nose is forced against the tear panel, the score initially ruptures at a vent region of the score. This initial rupture of the score is primarily caused by the lifting force on the tab resulting in lifting of a central region of the can end, including the rivet and immediately adjacent the rivet. As the tab is lifted further, the score rupture propagates along the length of the score, eventually stopping at the hinge segment.

Venting is an initial release of pressure from within a pressurized container upon initial fracture of the score about the tear panel, typically upon the initial lifting of the lift end of the tab by a user.

In general, beverage can end design requires a careful balancing of structural elements to achieve a beverage can end of a desired strength while maintaining proper function of the SOT opening assembly. Changes to one structural element to improve one physical characteristic of the beverage can end will routinely adversely affect a different physical characteristic.

Frangible score geometry plays a large role in the openability of such a beverage can end. It is desirable for the frangible score to fracture properly and for the fracture to propagate about the tear panel from one end of the frangible score to the other. Manufacturers often seek to alter frangible score geometry to enlarge the tear panel opening to improve pourability; however, often when pourability is improved, the design change or score geometry change may adversely affect openability.

Thus, the problem addressed by the inventors can be stated: in a beverage can end or lid comprising a stay-on-tab ecology opening assembly, what is alternative tear panel geometry that produces a suitable pour opening area and shape and that opens in a manner where the fracture of the frangible score propagates from a first end adjacent the rivet about a curvilinear path to a second end wherein the first end and the second end are separated by a non-frangible hinge segment of the center panel. One goal of the present invention to increase or improve pourability without sacrificing openability.

The present invention is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY OF THE INVENTION

The present invention is generally directed to an ecology stay-on tab beverage can end comprising a circumferential curl centered about a longitudinal axis. A circumferential wall extends downwardly from the curl. A circumferential strengthening member is located downwardly from the wall. A center panel is located radially inwardly from the strengthening member and is centered about the longitudinal axis.

The center panel comprises a tab having a lift end opposite a nose end. A rivet attaches a tab to the center panel. A first axis extends through the rivet, the lift end of the tab, and the nose end of the tab and perpendicular to the longitudinal axis. A tear panel is defined by a frangible score and a non-frangible hinge that joins a first end of the frangible score with a second end of the frangible score. The first axis forms a line of asymmetry of the tear panel. A second axis intersects the first axis at a right angle at a midpoint of a first axis segment defined by a length between a first point where the first axis intersects the frangible score near the rivet and a second point where the first axis intersects the frangible score and which is located radially outwardly of the first point. An intersection of the first axis with the second axis defines a center point of a clock-like reference of the frangible score having a 12 o'clock position at the first point and a 6 o'clock position at the second point.

According to a first aspect of the invention, the frangible score has a first radius of curvature between a 5 o'clock position and a 7 o'clock position that is at least 3.6 times larger than a second radius of curvature between a 7 o'clock position and a 9 o'clock position.

The first aspect of the invention may include one or more of the following features, alone or in any reasonable combination. The first radius of curvature may be at least 4.5 times larger than the second radius of curvature. The first radius of curvature may be between 4.5 to 10 times larger than the second radius of curvature. A third axis may intersect the first axis at a right angle at a distance from the first point on the frangible score located radially outwardly from the midpoint of the first axis segment relative to the longitudinal axis and have a third axis segment defined by a length of the third axis between a fifth point on the frangible score and a sixth point on the frangible score, wherein a ratio of the length of the third axis segment to the length of the first axis segment is greater than 1.2. A second axis segment may be defined by a length of the second axis between a third point on the frangible score located at the 3 o'clock position and a fourth point on the frangible score located at the 9 o'clock position wherein a third axis intersects the first axis at a right angle at a distance from the first point on the frangible score located radially outwardly from the midpoint of the first axis segment relative to the longitudinal axis, and a third axis segment may be defined by a length of the third axis between a fifth point on the frangible score and a sixth point on the frangible score, wherein a ratio of the length of the second axis segment to the length of the third axis segment is less than 1.0.

According to second aspect of the invention, a third axis intersects the first axis at a right angle at a distance from the first point on the frangible score located radially outwardly from the midpoint of the first axis segment relative to the longitudinal axis. A third axis segment is defined by a length of the third axis between a fifth point on the frangible score and a sixth point on the frangible score. A ratio of the length of the third axis segment to the length of the first axis segment is greater than 1.2.

The second aspect of the invention may include one or more of the following features, alone or in any reasonable combination. The ratio may be between 1.2 and 1.5. The ratio may be between 1.27 and 1.46. In a 202-sized can end, the ratio may be between 1.40 and 1.46. In a 209-sized can end, the ratio may be between 1.27 and 1.30. A second axis segment may be defined by a length of the second axis between a third point on the frangible score located at the 3 o'clock position and a fourth point on the frangible score located at the 9 o'clock position wherein a ratio of the length of the second axis segment to the length of the third axis segment is less than 1.0.

According to a third aspect of the invention, a second axis segment is defined by a length of the second axis between a third point on the frangible score located at the 3 o'clock position and a fourth point on the frangible score located at the 9 o'clock position. A third axis intersects the first axis at a right angle at a distance from the first point on the frangible score located radially outwardly from the midpoint of the first axis segment relative to the longitudinal axis. A third axis segment is defined by a length of the third axis between a fifth point on the frangible score and a sixth point on the frangible score. A ratio of the length of the second axis segment to the length of the third axis segment is less than 1.0. The third axis may extend across a maximum width of the frangible score which is located radially outwardly of the midpoint of the first axis segment relative to the longitudinal axis.

Each of the aspects of the invention may include one or more of the following features alone or in any combination. The tear panel may have a surface area between 0.50 square inches (3.23 $cm^2$) and 0.80 square inches (5.16 $cm^2$). A tear panel opening sequence may include lifting upwardly on the lift end of the tab causing a fracture of the frangible score to propagate clockwise towards the second end of the frangible score wherein the tear panel is deflected downwardly about the hinge segment. An anti-fracture score may be located radially inwardly of the frangible score relative to the center point of the clock-like reference and generally following the shape thereof. The tear panel and the rivet may be located in a deboss panel recessed in the center panel. The circumferential strengthening member may be a generally U-shaped countersink. The can end may be a 209-sized can end. The can end may be a 202-sized can end.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
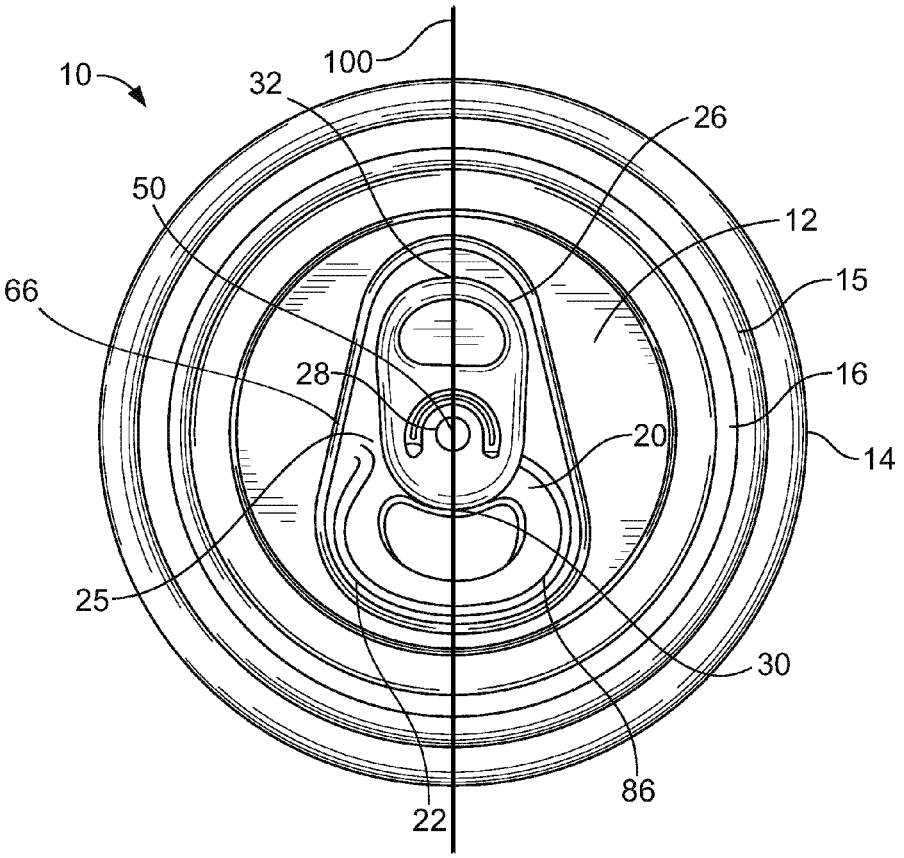
FIG. 1 (PRIOR ART)
FIG. 1 is a top view of an SOT beverage can end that is known in the art of beverage can end design.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention provides a beverage can end aimed at providing a tear panel with a distinctive, unique geometry.

Figure 2:
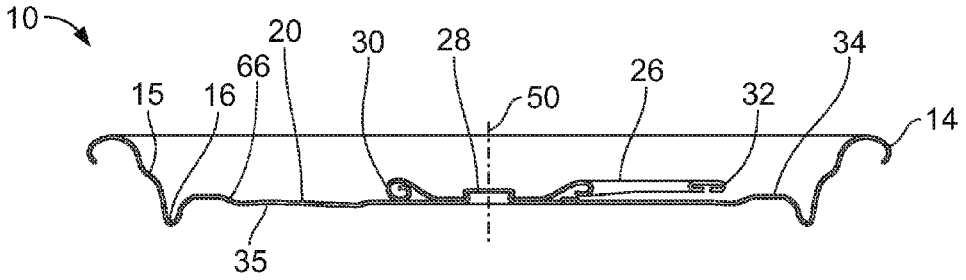
FIG. 2 (PRIOR ART)
FIG. 2 is a cross-sectional view of the can end of FIG. 1 taken through a central axis.
Figure 3:
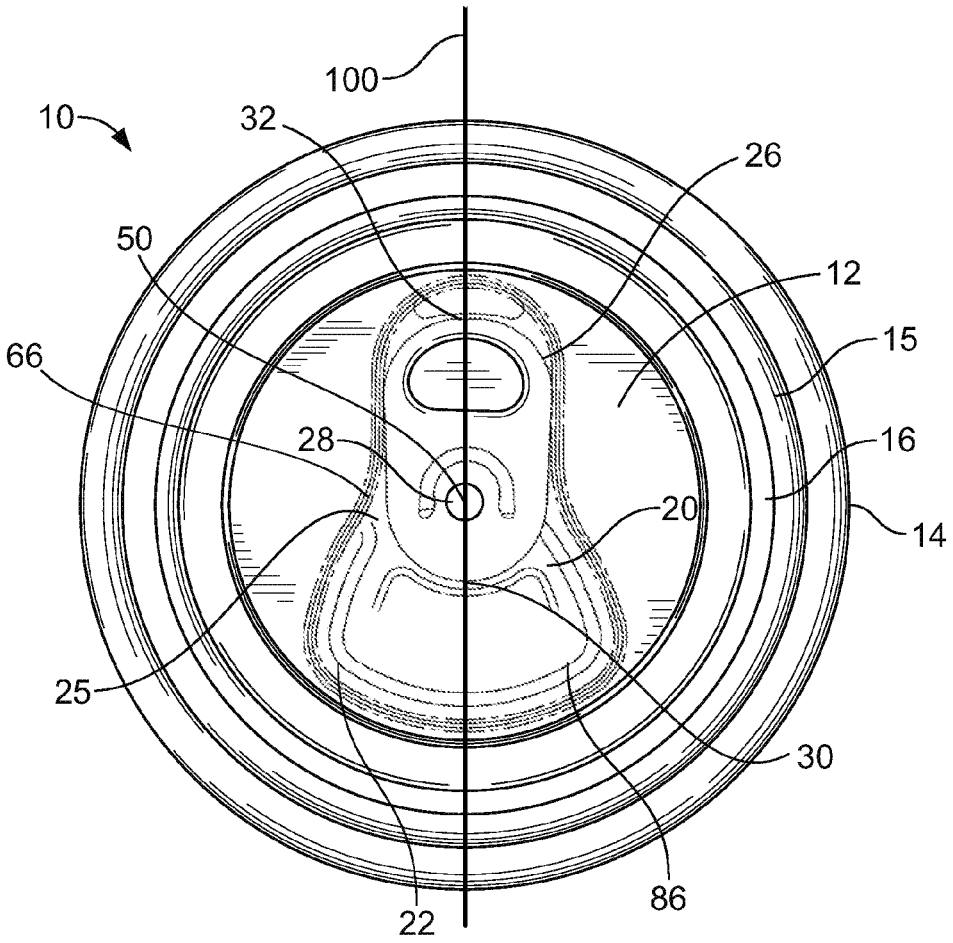
FIG. 3 is a top view of an SOT beverage can end having a frangible score and tear panel geometry of the present invention.
Figure 5:
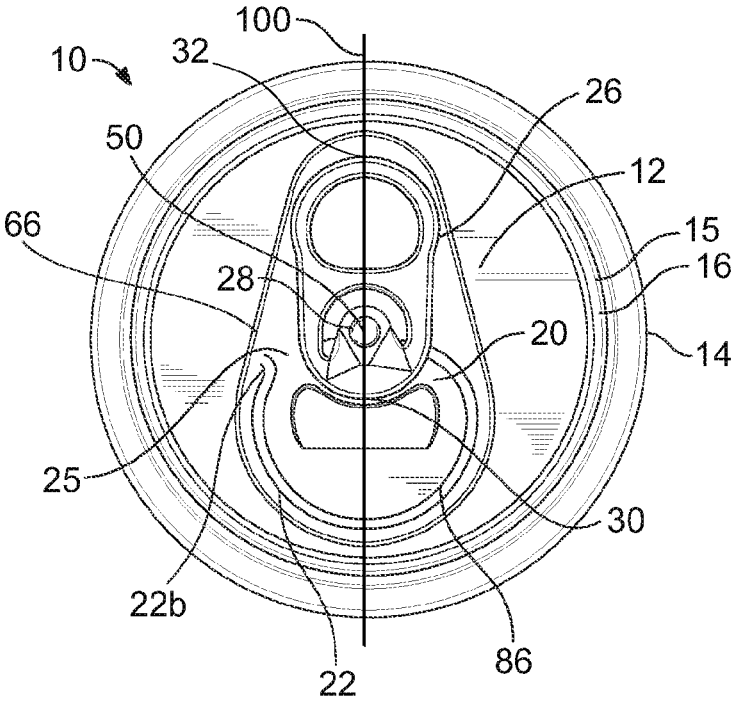
FIG. 5 (PRIOR ART)
FIG. 5 is a top view of an SOT beverage can end that is known in the art of beverage can end design.
Figure 6:
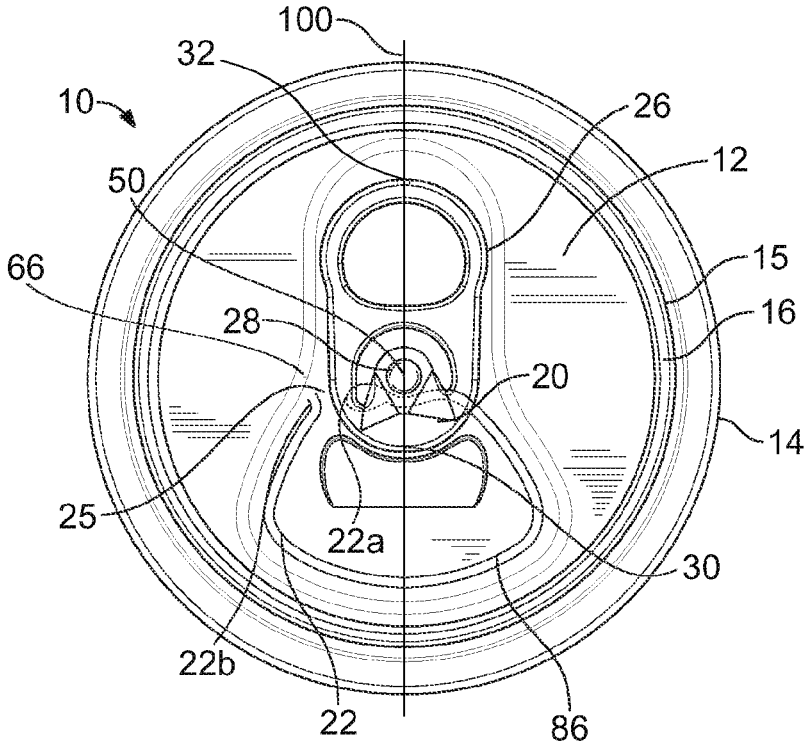
FIG. 6 is a top view of an SOT beverage can end having a frangible score and tear panel geometry of the present invention.

Referring generally to FIGS. 1, 2, and 5, known beverage can ends 10 for containers (not shown) have a center panel 12 separated from a seaming curl 14 by a circumferential wall 15 extending downwardly from the seaming curl 14 to a strengthening segment 16 which is joined to the center panel 12. The container is typically a drawn and ironed metal can, usually constructed from a thin plate of aluminum or steel. Beverage can ends for such containers are also typically constructed from a cutedge of thin plate of aluminum or steel, formed into blank end, and manufactured into a finished end by a process often referred to as end conversion.

The can end 10 can be joined to a container body by the seaming curl 14 which is joined to a mating curl of the container body. The seaming curl 14 of the can end 10 is integral with the center panel 12 by the circumferential wall 15 and the strengthening segment 16, typically either a generally U-shaped countersink or a fold, which is joined to a peripheral edge of the center panel 12, defining an outer perimeter of the center panel 12, often through an additional strengthening feature such as a circumferential step or other circumferential wall. This type of means for joining the center panel 12 to a container body is presently the typical means for joining used in the industry, and the curl structure described above is formed in the process of forming the blank end from a cutedge of metal plate, prior to the end conversion process. However, other means for joining the beverage can end to a container body may be employed with the present invention.

The steps of manufacturing the can end 10 begin with blanking the cutedge, typically a round or non-round cutedge of thin metal plate. Examples of non-round cutedge blanks include elliptical cutedges, convoluted cutedges, and harmonic cutedges. A convoluted cutedge may be described as generally having three distinct diameters, each diameter being 45° relative to the others. The cutedge is then formed into a blank end by forming the seaming curl, countersink, panel radius and the center panel.

The conversion process for this type of beverage can end includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead or panel on the tear panel; forming a deboss panel by bending the metal of the center panel such that a central area of the center panel is slightly lower than the remaining center panel; staking a tab to the rivet; and other subsequent operations such as wipe-down steps to remove sharp edges of the tab, lettering on the center panel by scoring, incising, or embossing (or debossing), and restriking the rivet island.

The circumferential seaming curl 14 defines an outer perimeter of the beverage can end 10. It is generally centered about a longitudinal or vertical axis 50, typically located at a center of the rivet.

The center panel 12 has a displaceable tear panel 20 defined by a frangible score and a non-frangible hinge segment 25. The tear panel 20 of the center panel 12 may be opened, that is the frangible score may be severed and the tear panel 20 displaced at an angular orientation relative to the remaining portion of the center panel 12, while the tear panel 20 remains connected to the center panel 12 through a hinge segment 25, to define a dispensing port or pour opening. In this opening operation, the tear panel 20 is displaced at an angular deflection. More specifically, the tear panel 20 is deflected at an angle relative to a plane of the center panel 12, with the vortex of the angular displacement being the hinge segment 25.

The tear panel 20 is formed during the conversion process by a scoring operation. The tools for scoring the tear panel 20 into the center panel 12 include an upper die on a public side 34 having a scoring knife edge in the shape of the tear panel 20, and a lower die on the product side 35 to support the metal in the regions being scored. When the upper and lower dies are brought together, the metal of the center panel 12 is scored between the dies. This results in the scoring knife edge being embedded into the metal of the center panel 12, forming a score groove 22 which appears as a wedge-shaped recess in the metal. The metal remaining below the wedge-shaped recess is the residual of the score groove 22. Therefore, the score groove 22 is formed by the scoring knife edge causing movement of metal, such that the imprint of the scoring knife edge is made in the public side 34 of the center panel 12.

The center panel 12 has a public side 34 and an opposing product side 35 and further includes a tab 26. The tab 26 has a generally elongated body along a diametric first axis 100 extending through a tab nose 30, a central webbing and the lift end 32 and perpendicular to the longitudinal axis 50. Typical prior art can ends often have a tab 26 which is staked in the final steps of the conversion process by staking the area of the center panel 12 adjacent and under the rivet island 46 at an angle, to bias the tab 26 such that the lift end 32 of the tab 26 rests close to the center panel 12. The center panel 12 may also have a recess near the lift end 32 of the tab 26 to allow for easier finger access.

The opening of the tear panel 20 is operated by the tab 26 which is attached to the center panel 12 by a rivet 28 spaced from the tear panel 20, generally through a rivet aperture in a rivet island of the tab 26. The lift end 32 of the tab 26 is located opposite the tab nose 30. Typically, the central webbing of the tab provides access for a user to lift the lift end 32, such as with the user's finger.

Alternatively, the tab 26 may be attached to the center panel 12 by an adhesive.

The rivet 28 is surrounded by a circular coined region of the center panel 12. The coined region is a compressed portion of the center panel 12 having a localized reduced thickness relative to adjacent portions of the center panel. The score groove 22 generally includes a segment that travels through this coned region. A raised, curvilinear bead may be located about the coined region so that it partially surrounds the coined region without intersecting or extending onto the tear panel 20.

A deboss panel 66 is formed in the public side 34 of the center panel 12. The deboss panel 66 is formed in the center panel 12 using conventional die-forming techniques. The tab 26 and the tear panel 20 are typically located within the recessed deboss panel 66.

For purposes of description and location of elements, the first axis 100 of the can end 10 extends through the nose end 30 and lift end 32 of the tab 26 and through a center of the rivet 28. The first axis 100 will generally bisect a tab of bilateral symmetry as illustrated. Thus, the first axis 100 travels along a diameter of the can end 10, assuming a round can end 10.

As illustrated, for discussion purposes, and as is the case for all known commercially available beverage containers of this type, the score groove 22 has first end **22*a* located under the tab 26 separated from a terminal end 22*b* by the non-frangible hinge portion 25. A portion of the score groove 22 is severed during an opening sequence which progresses in a clockwise fashion from a vent region towards the terminal end 22*b* of the score line 22**. One of ordinary skill in the art could readily adapt the teachings set forth herein to a can using a counterclockwise opening sequence if so desired.

Starting with the beginning end and moving clockwise about the score line 22, the score line comprises a vent region located at least partially beneath the tab 26 and has a segment lying very close to the rivet 28. As will be described below, the vent region is the portion of the score groove 22 where opening of the tear panel 20 is initiated. The vent region is where an initial "pop" takes place and where an internal pressure within beverage container is safely exhausted during the opening sequence as the score line 22 in the vent region is fractured. The concept of a vent region is generally well-known in the prior art.

An anti-fracture score 86 may be placed adjacent the score line 22 as is known in the art. The anti-fracture score 86 is generally a shallower score relative to the frangible score groove 22. It follows a path generally parallel to a path followed by the frangible score groove 22 over most of its length, typically departing from this parallel path at the first end of the score groove 22 and spaced from the frangible score groove 22 less than 0.05 inches (0.13 cm). The anti-fracture score 86 is typically located on the tear panel 20, but may be located outside the perimeter of the tear panel 20. The generally accepted purpose of the anti-fracture score 86 to those of ordinary skill in the art is to reduce residual stresses associated with the frangible score groove 22 so as to prevent or minimize the occurrence of microcracks in, or premature fracture along, the score groove 22. Thus, the anti-fracture score 86 has been found useful in protecting the frangible score groove 22. Ideally and by design, no rupture occurs along the anti-fracture score 86 in normal operation.

The opening sequence may be described as follows. The tab 26 begins in a stowage position as illustrated. The stowage position is the position of the tab 26 in which the beverage container is customarily delivered, i.e. handled subsequent to filling and prior to opening. Here, in the stowage position, the first axis 100 extends from the lift end 32 of the tab 26 through the nose end 30 of the tab 26. Thus, in the present invention, the pour panel opening position, or frangible score groove opening position, is also the stowage position. The user actuated lifting of the tab 26 is directed upwardly relative to the public side 34 of the center panel 12 without user introduced rotation of the rivet island of the tab 26 about the rivet 28 in either a clockwise or counterclockwise direction. The tear panel 20 is retained to the center panel 12 by the hinge segment 25 subsequent to opening.

As illustrated in FIGS. 3, 4, 6, and 7, an embodiment of a beverage can end 10 of the present invention includes a tear panel geometry that is unique and distinct from tear panel geometries known in the art. The frangible score groove 22 of the present invention includes features that give the tear panel 20 a remarkably different appearance and functionality. More specifically, ratios of certain radius of curvatures are altered to arrive at tear panel 20 that is openable yet is very different from known SOT beverage can ends.

As a frame of reference only, a second axis 200 intersects the first axis 100 at a right angle at a midpoint of a first axis segment 102 defined by a length between a first point 104 where the first axis 100 intersects the frangible score 22 near the rivet 28 and a second point 106 where the first axis 100 intersects the frangible score 22 which is located radially outwardly of the first point 104 relative to the longitudinal axis 50. An intersection of the first axis 100 with the second axis 200 defines a center point 80 of a clock-like reference of the frangible score 22 having a 12 o'clock position at the first point 104 and a 6 o'clock position at the second point 106. This clock-like reference is best illustrated in FIGS. 4 and 7, although it applies equally to top views of the can end 10 as well.

The length of the first axis segment 102 is between 0.6 inches (1.5 cm) and 0.9 inches (2.3 cm). In a 202-sized can end, the length of the first axis segment 102 is less than 0.9 inches (2.3 cm), more preferably less than 0.8 inches (2.0 cm), still more preferably less than 0.7 inches (1.8 cm), and most preferably about 0.69 inches (1.75 cm). In a 209-sized can end, the length of the first axis segment 102 is greater than 0.6 inches (1.5 cm), more preferably greater than 0.7 inches (1.8 cm), still more preferably greater than 0.8 inches (2.0 cm), and most preferably about 0.81 inches (2.06 cm).

Generally speaking, a curvilinear frangible score 22 of the present invention is similar to many frangible scores known in the art in that the frangible score 22 features a plurality of curvatures along its length, each having a different radius of curvature. However, the frangible score 22 of the present invention is vastly different in overall appearance, owing to the magnitudes of the radius of curvatures and locations of the curves, and it is asymmetrically skewed relative to the first axis 100.

Figure 4:
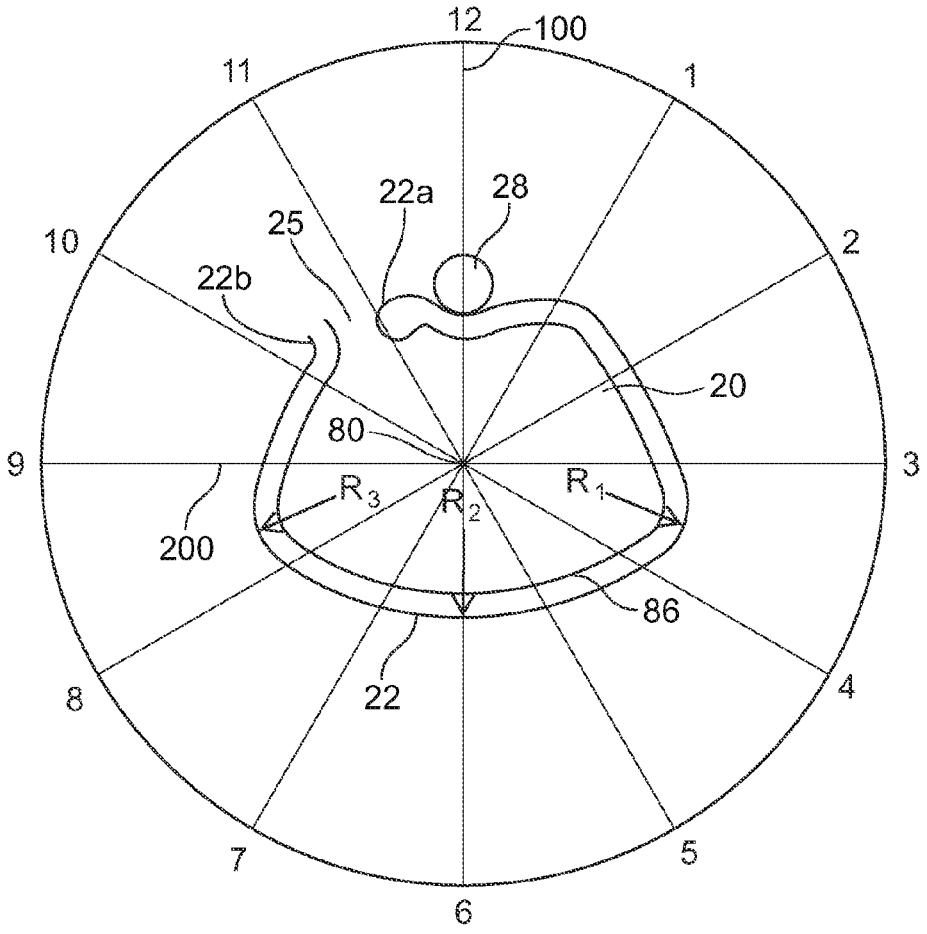
FIG. 4 is a magnified top view of a frangible score for a 202-size SOT beverage can end of the present invention.
Figure 7:
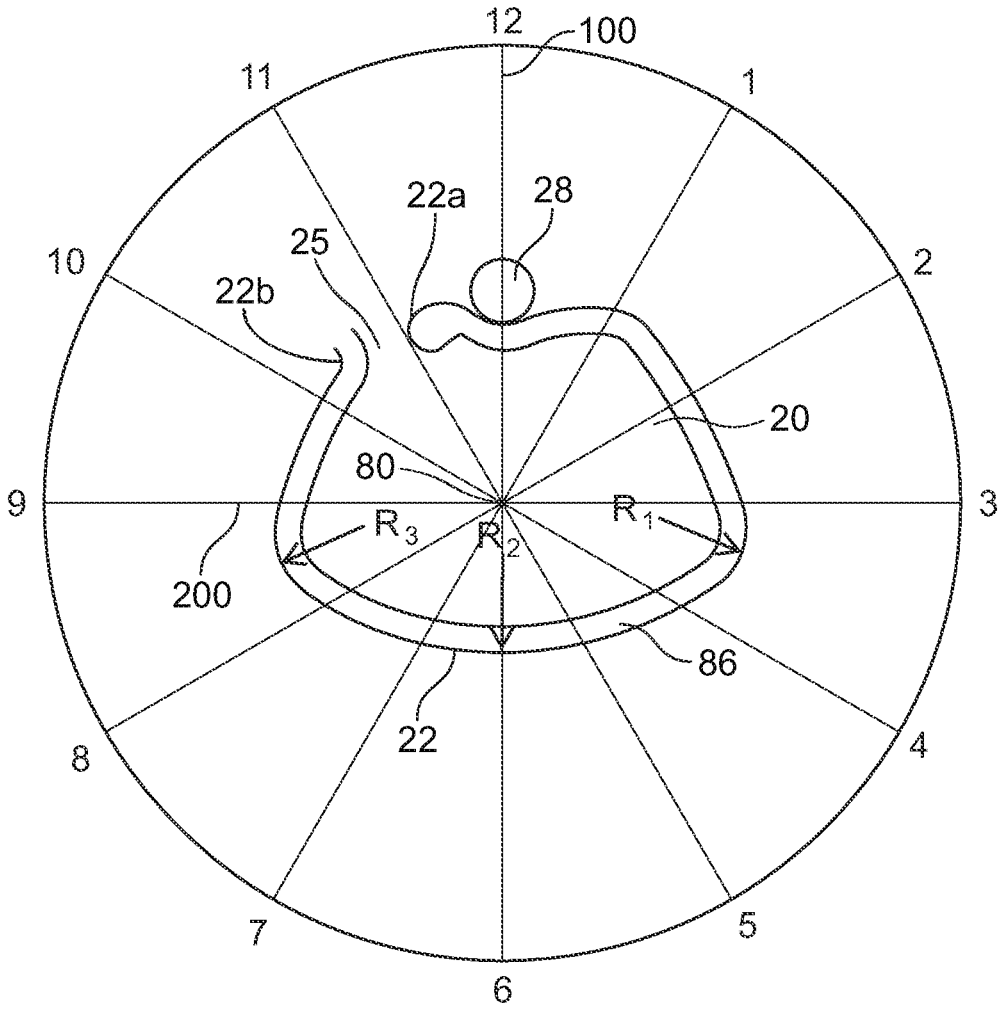
FIG. 7 is a magnified top view of a frangible score for a 209-size SOT beverage can end of the present invention.

For example, referring to FIGS. 4 and 7, the frangible score 22 has a bend between the 1 o'clock and 2 o'clock positions that is relatively very small. This smaller radius of curvature is bounded by a bend having a very large radius of curvature between the 1 o'clock and 4 o'clock positions wherein this very large radius of curvature intersects the 3 o'clock position. Between the 3 o'clock and 5 o'clock positions, the frangible score 22 has a radius of curvature $R_1$. Between the 5 o'clock and 7 o'clock positions, the frangible score has a radius of curvature $R_2$. Between the 7 o'clock and 9 o'clock positions, the frangible score has a radius of curvature $R_3$. The frangible score 22 has a bend having a very large radius of curvature that intersects the 9 o'clock position and that is slightly smaller than the bend having a very large radius of curvature that intersects the 3 o'clock position. From a magnitude standpoint, $R_3$ is between 0.15 inches (0.38 cm) to 0.25 inches (0.64 cm). $R_1$ is similar to $R_3$; however, it can be slightly larger than $R_3$. The magnitude of $R_2$ is generally on the order of 3.6 to 10 times the magnitude of either $R_1$ or $R_3$, typically 0.54 inches (1.37 cm) to 2.5 inches (6.35 cm).

In one embodiment, the frangible score 22 has a radius of curvature between the 5 o'clock position and the 7 o'clock position which is at least 3.6 times larger than a radius of curvature between the 3 o'clock position and the 5 o'clock position.

Figure 8:
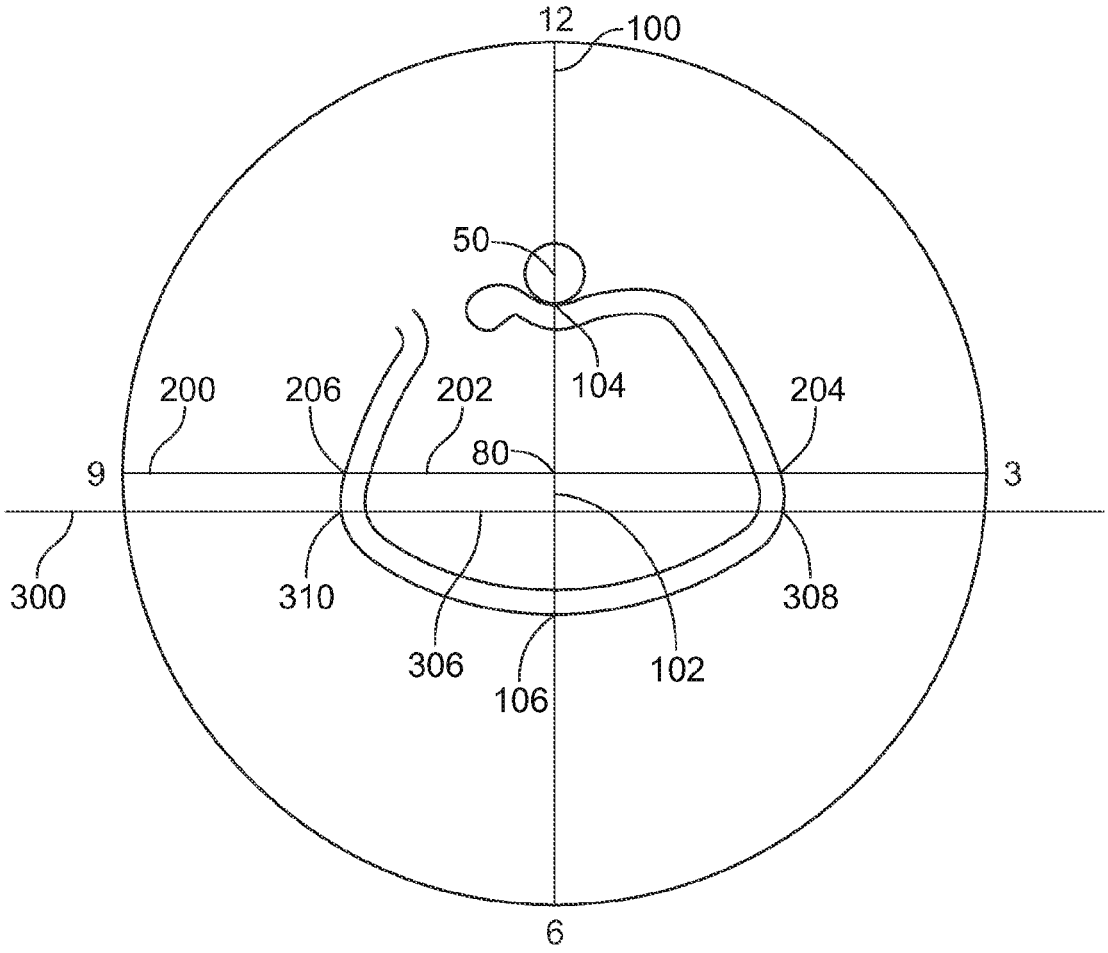
FIG. 8 is a magnified top view of a frangible score of the present invention.

As illustrated in FIG. 8, a second axis segment 202 is defined by the length of the second axis 200 between a third point 204 on the frangible score 22 located at the 3 o'clock position and a fourth point 206 on the frangible score 22 located at the 9 o'clock position.

Still referring to FIG. 8, a third axis 300 intersects the first axis 100 at a right angle at a distance from the first point 104 on the frangible score 22 located radially outwardly from the center point 80 of the clock-like reference relative to the longitudinal axis 50. A third axis segment 306 is defined by a length of the third axis 300 between a fifth point 308 on the frangible score and a sixth point 310 on the frangible score, each defined by a location on the frangible score 22 intersected by the third axis 300 at the widest point of the frangible score 22 parallel to the second axis 200.

In one embodiment, the third axis 300 extends across a maximum width of the frangible score 22 which is located radially outwardly of the midpoint of the first axis segment 102 relative to the longitudinal axis 50. The length of the third axis segment 306 is between 0.9 inches (2.3 cm) and 1.1 inches (2.8 cm). In a 202-sized can end, the length of the third axis segment 306 is less than 1.1 inches (2.8 cm), more preferably less than 1.0 inches (2.5 cm), still more preferably between 1.0 inches (2.5 cm) and 0.9 inches (2.3 cm), and most preferably between 0.96 inches (2.44 cm) and 1.01 inches (2.57 cm). In a 209-sized can end, the length of the third axis segment 306 is greater than 1.0 inches (2.5 cm), more preferably greater than 1.02 inches (2.59 cm), still more preferably between 1.02 inches (2.59 cm) and 1.10 inches (2.79 cm), and most preferably between 1.03 inches (2.59 cm) and 1.05 inches (2.67 cm).

A ratio of the length of the third axis segment 306 to the length of the first axis segment 102 is generally between 1.2 and 1.5. More preferably, the ratio is between 1.27 and 1.46. Most preferably, in a 202-sized can end, the ratio is between 1.40 and 1.46, and in a 209-sized can end, the ratio is between 1.27 and 1.30.

In one embodiment, the ratio of the length of the third axis segment 306 to the first axis segment 102 is greater than 1.2.

In one embodiment, a ratio of the length of the second axis segment 202 to the length of the third axis segment 306 is less than 1.0.

The tear panel 20 further has a surface area between 0.50 square inches (3.23 $cm^2$) and 0.80 square inches (5.16 $cm^2$). In a 202-size can end, the surface area of the tear panel 20 is between 0.50 square inches (3.23 $cm^2$) and 0.60 square inches (3.87 $cm^2$). More preferably, the surface area is between 0.55 square inches (3.58 $cm^2$) and 0.59 square inches (3.81 $cm^2$). Still more preferably, the surface area is between 0.56 square inches (3.61 $cm^2$) and 0.58 square inches (3.74 $cm^2$). In a 209-size can end, the surface area of the tear panel 20 is between 0.60 square inches (3.87 $cm^2$) and 0.80 square inches (5.16 $cm^2$). More preferably, the surface area is between 0.65 square inches (4.19 $cm^2$) and 0.75 square inches (4.84 $cm^2$). Still more preferably, the surface area is between 0.69 square inches (4.45 $cm^2$) and 0.71 square inches (4.58 $cm^2$).

The fracture of the frangible score depicted in FIG. 8 propagates accordingly during an opening sequence wherein lifting upwardly on the lift end of the tab causes a fracture of the frangible score to propagate clockwise towards the second end of the frangible score and wherein the tear panel is deflected downwardly about the hinge segment. More particularly, upon lifting the lift end 32 of the tab 26, the vent region of the frangible score 22 fractures. Further lifting of the tab 26, causes the fracture to propagate clockwise about the tear panel 20 to the terminal end 22*b* of the frangible score 22. The tear panel 20 is deflected about the hinge segment 25 into the beverage container.

The terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings. The term "bead" as used herein indicates forming a tactile feature in either high relief or low relief wherein a recess is formed in either the public side or product side of the beverage can end with a corresponding low relief or high relief on the opposite side of the beverage can end. Beading is well-known in the art as differentiated from other forming techniques.

While the specific embodiments have been illustrated and described, numerous modifications come to mind without significantly departing from the spirit of the invention, and the scope of protection is only limited by the scope of the accompanying Claims.

What is claimed is:

1. An ecology stay-on tab beverage can end comprising:
a circumferential curl centered about a longitudinal axis;
a circumferential wall extending downwardly from the curl;
a circumferential strengthening member located downwardly from the wall; and
a center panel located radially inwardly from the strengthening member and centered about the longitudinal axis comprising:
a tab having a lift end opposite a nose end;
a rivet attaching a tab to the center panel;
a first axis extending through the rivet, the lift end of the tab, and the nose end of the tab and perpendicular to the longitudinal axis;
a tear panel defined by a frangible score and a non-frangible hinge that joins a first end of the frangible score with a second end of the frangible score, wherein the first axis forms a line of asymmetry of the tear panel; and
a second axis intersecting the first axis at a right angle at a midpoint of a first axis segment defined by a length between a first point where the first axis intersects the frangible score near the rivet and a second point where the first axis intersects the frangible score and which is located radially outwardly of the first point, wherein an intersection of the first axis with the second axis defines a center point of a clock-like reference of the frangible score having a 12 o'clock position at the first point and a 6 o'clock position at the second point,
wherein the frangible score has a convex first radius of curvature between a 5 o'clock position and a 7 o'clock position that is at least 3.6 times larger than a convex second radius of curvature between a 7 o'clock position and a 9 o'clock position, and
wherein a convex third radius of curvature located between a 1 o'clock position and a 2 o'clock position is less than a convex fourth radius of curvature between the 1 o'clock position and a 4 o'clock positions wherein the fourth radius of curvature intersects a 3 o'clock position.

2. The ecology stay-on tab beverage can end of claim 1 wherein the first radius of curvature between a 5 o'clock position and a 7 o'clock position that is at least 4.5 times larger than the second radius of curvature between a 7 o'clock position and a 9 o'clock position.

3. The ecology stay-on tab beverage can end of claim 1 wherein the first radius of curvature between a 5 o'clock position and a 7 o'clock position that is between 4.5 to 10 times larger than the second radius of curvature between a 7 o'clock position and a 9 o'clock position.

4. The ecology stay-on tab beverage can end of claim 1 wherein the tear panel has a surface area between 0.50 square inches (3.23 $cm^2$) and 0.80 square inches (5.16 $cm^2$).

5. The ecology stay-on tab beverage can end of claim 1 further comprising a tear panel opening sequence wherein lifting upwardly on the lift end of the tab causes a fracture of the frangible score to propagate clockwise towards the second end of the frangible score and wherein the tear panel is deflected downwardly about the hinge segment.

6. The ecology stay-on tab beverage can end of claim 1 further comprising:
a third axis intersecting the first axis at a right angle at a distance from the first point on the frangible score located radially outwardly from the midpoint of the first axis segment relative to the longitudinal axis and having a third axis segment defined by a length of the third axis between a fifth point on the frangible score and a sixth point on the frangible score, wherein a ratio of the length of the third axis segment to the length of the first axis segment is greater than 1.2.

7. The ecology stay-on tab beverage can end of claim 1 wherein a second axis segment is defined by a length of the second axis between a third point on the frangible score located at the 3 o'clock position and a fourth point on the frangible score located at the 9 o'clock position; and further comprising:

a third axis intersecting the first axis at a right angle at a distance from the first point on the frangible score located radially outwardly from the midpoint of the first axis segment relative to the longitudinal axis and having a third axis segment defined by a length of the third axis between a fifth point on the frangible score and a sixth point on the frangible score, wherein a ratio of the length of the second axis segment to the length of the third axis segment is less than 1.0.

8. The ecology stay-on tab beverage can end of claim 1 further comprising:

an anti-fracture score located radially inwardly of the frangible score relative to the center point of the clock-like reference and generally following the shape thereof.

9. The ecology stay-on tab beverage can end of claim 1 further comprising:

a deboss panel in which the tear panel and the rivet are recessed in the center panel.

10. The ecology stay-on tab beverage can end of claim 1 wherein the circumferential strengthening member is a generally U-shaped countersink.

11. The ecology stay-on tab beverage can end of claim 1 wherein the can end is a 209-sized can end.

12. The ecology stay-on tab beverage can end of claim 1 wherein the can end is a 202-sized can end.

13. An ecology stay-on tab beverage can end comprising:

a circumferential curl centered about a longitudinal axis;

a circumferential wall extending downwardly from the curl;

a circumferential strengthening member located downwardly from the wall; and a center panel located radially inwardly from the strengthening member and centered about the longitudinal axis comprising:

a tab having a lift end opposite a nose end;

a rivet attaching a tab to the center panel;

a first axis extending through the rivet, the lift end of the tab, and the nose end of the tab and perpendicular to the longitudinal axis;

a tear panel defined by a frangible score and a non-frangible hinge that joins a first end of the frangible score with a second end of the frangible score, wherein the first axis forms a line of asymmetry of the tear panel;

a second axis intersecting the first axis at a right angle at a midpoint of a first axis segment defined by a length of the first axis between a first point where the first axis intersects the frangible score near the rivet and a second point where the first axis intersects the frangible score which is located radially outwardly of the first point, wherein an intersection of the first axis with the second axis defines a center point of a clock-like reference of the frangible score having a 12 o'clock position at the first point and a 6 o'clock position at the second point; and a third axis intersecting the first axis at a right angle at a distance from the first point on the frangible score located radially outwardly from the midpoint of the first axis segment relative to the longitudinal axis and having a third axis segment defined by a length of the third axis between a fifth point on the frangible score and a sixth point on the frangible score, wherein a ratio of the length of the third axis segment to the length of the first axis segment is greater than 1.2.

14. The ecology stay-on tab beverage can end of claim 13 wherein the ratio is between 1.2 and 1.5.

15. The ecology stay-on tab beverage can end of claim 13 wherein the ratio is between 1.27 and 1.46.

16. The ecology stay-on tab beverage can end of claim 13 wherein in a 202-sized can end, the ratio is between 1.40 and 1.46.

17. The ecology stay-on tab beverage can end of claim 13 wherein a 209-sized can end, the ratio is between 1.27 and 1.30.

18. The ecology stay-on tab beverage can end of claim 13 wherein the tear panel has a surface area between 0.50 square inches (3.23 $cm^2$) and 0.80 square inches (5.16 $cm^2$).

19. The ecology stay-on tab beverage can end of claim 13 further comprising a tear panel opening sequence wherein lifting upwardly on the lift end of the tab causes a fracture of the frangible score to propagate clockwise towards the second end of the frangible score and wherein the tear panel is deflected downwardly about the hinge segment.

20. The ecology stay-on tab beverage can end of claim 13 further comprising:

an anti-fracture score located radially inwardly of the frangible score relative to the center point of the clock-like reference and generally following the shape thereof.

21. The ecology stay-on tab beverage can end of claim 13 further comprising:

a deboss panel in which the tear panel and the rivet are recessed in the center panel.

22. The ecology stay-on tab beverage can end of claim 13 wherein the circumferential strengthening member is a generally U-shaped countersink.

23. The ecology stay-on tab beverage can end of claim 13 wherein the can end is a 209-sized can end.

24. The ecology stay-on tab beverage can end of claim 13 wherein the can end is a 202-sized can end.

25. The ecology stay-on tab beverage can end of claim 13 wherein a second axis segment is defined by a length of the second axis between a third point on the frangible score located at the 3 o'clock position and a fourth point on the frangible score located at the 9 o'clock position, and wherein a ratio of the length of the second axis segment to the length of the third axis segment is less than 1.0.

26. An ecology stay-on tab beverage can end comprising:

a circumferential curl centered about a longitudinal axis;

a circumferential wall extending downwardly from the curl;

a circumferential strengthening member located downwardly from the wall; and a center panel located radially inwardly from the strengthening member and centered about the longitudinal axis comprising:

a tab having a lift end opposite a nose end;

a rivet attaching a tab to the center panel;

a first axis extending through the rivet, the lift end of the tab, and the nose end of the tab and perpendicular to the longitudinal axis;

a tear panel defined by a frangible score and a non-frangible hinge that joins a first end of the frangible score with a second end of the frangible score, wherein the first axis forms a line of asymmetry of the tear panel;

a second axis intersecting the first axis at a right angle at a midpoint of a first axis segment defined by a length of the first axis between a first point where the first axis intersects the frangible score near the rivet and a second point where the first axis intersects the frangible score which is located radially outwardly of the first point, wherein an intersection of the first axis with the second axis defines a center point of a clock-like reference of the frangible score having a 12 o'clock position at the first point and a 6 o'clock position at the second point, wherein a second axis segment is defined by a length of the second axis between a third point on the frangible score located at the 3 o'clock position and a fourth point on the frangible score located at the 9 o'clock position; and a third axis intersecting the first axis at a right angle at a distance from the first point on the frangible score located radially outwardly from the midpoint of the first axis segment relative to the longitudinal axis and having a third axis segment defined by a length of the third axis between a fifth point on the frangible score and a sixth point on the frangible score, wherein a ratio of the length of the second axis segment to the length of the third axis segment is less than 1.0.

27. The ecology stay-on tab beverage can end of claim 26 wherein the third axis extends across a maximum width of the frangible score which is located radially outwardly of the midpoint of the first axis segment relative to the longitudinal axis.

28. The ecology stay-on tab beverage can end of claim 26 wherein the tear panel has a surface area between 0.50 square inches (3.23 $cm^2$) and 0.80 square inches (5.16 $cm^2$).

29. The ecology stay-on tab beverage can end of claim 26 further comprising a tear panel opening sequence wherein lifting upwardly on the lift end of the tab causes a fracture of the frangible score to propagate clockwise towards the second end of the frangible score and wherein the tear panel is deflected downwardly about the hinge segment.

30. The ecology stay-on tab beverage can end of claim 26 further comprising:

an anti-fracture score located radially inwardly of the frangible score relative to the center point of the clock-like reference and generally following the shape thereof.

31. The ecology stay-on tab beverage can end of claim 26 further comprising:

a deboss panel in which the tear panel and the rivet are recessed in the center panel.

32. The ecology stay-on tab beverage can end of claim 26 wherein the circumferential strengthening member is a generally U-shaped countersink.

33. The ecology stay-on tab beverage can end of claim 26 wherein the can end is a 209-sized can end.

34. The ecology stay-on tab beverage can end of claim 26 wherein the can end is a 202-sized can end.

* * * * *